US005225643A

United States Patent [19]

Marchant

[11] Patent Number: 5,225,643

[45] Date of Patent: Jul. 6, 1993

[54] DIFFERENTIAL PRESSURE SWITCH FOR STORED GAS PRESSURE VESSEL

[75] Inventor: Brent R. Marchant, Ogden, Utah

[73] Assignee: Morton International, Inc., Chicago, Ill.

[21] Appl. No.: 852,474

[22] Filed: Mar. 17, 1992

[51] Int. Cl.[5] ..... H01H 35/34

[52] U.S. Cl. ..... 200/834; 73/717; 200/83 N; 340/605

[58] Field of Search ..... 73/716, 717, 723; 340/605, 626; 307/118; 200/83 R, 83 A, 83 P, 83 B, 83 N, 83 Y, 302.1

[56] References Cited

U.S. PATENT DOCUMENTS

| | | | |
|---|---|---|---|
| 1,582,154 | 4/1926 | Zeiher et al. . | |
| 2,582,483 | 1/1952 | Hallerberg | 200/83 Y |
| 2,656,428 | 10/1953 | Harris | 200/81.5 |
| 3,723,684 | 3/1973 | Greenwood | 200/83 R |
| 3,735,376 | 5/1973 | Kermer et al. | 340/242 |
| 3,760,350 | 9/1973 | Johnson | 340/58 |
| 3,818,764 | 6/1974 | Wagner | 73/393 |
| 3,829,640 | 8/1974 | Taylor | 200/83 N |
| 3,850,039 | 11/1974 | Brakebill | 73/420 |
| 3,859,845 | 1/1975 | Sawyer | 73/49.2 |
| 3,944,769 | 3/1976 | Wagner | 200/83 A |
| 4,049,935 | 9/1977 | Gruber | 200/83 P |
| 4,386,247 | 5/1983 | Couat | 200/61.25 |
| 5,073,124 | 12/1991 | Powell | 439/197 |
| 5,136,278 | 8/1992 | Watson | 340/626 |

FOREIGN PATENT DOCUMENTS

| | | |
|---|---|---|
| 2431178 | 8/1990 | France . |
| 726603 | 8/1980 | U.S.S.R. . |

*Primary Examiner*—Gerald P. Tolin

*Attorney, Agent, or Firm*—Gerald White; Mark LaMarre

[57] ABSTRACT

Two electrically conductive diaphragms which are disposed in generally parallel relation and are symmetrical mirror images of each other are joined to a non-conductive ring. The diaphragms are joined in a pressurized atmosphere of argon at, for example, 3000 psi. When so pressurized internally and with lower external pressure, the diaphragms do not contact each other. When pressurized externally to a pressure to a predetermined level higher than the internal pressure, the diaphragms make contact with each other to close an electric circuit. If pressure leaks into the switch or the external pressure drops, the diaphragms separate and break contact with each other.

9 Claims, 2 Drawing Sheets

DIFFERENTIAL PRESSURE SWITCH FOR STORED GAS PRESSURE VESSEL

BACKGROUND OF THE INVENTION

1. Field of the Invention

This invention relates to an improvement in a differential pressure switch which is responsive to the pressure of a stored gas, a control pressure, within the switch, and the differential between that pressure and the pressure of the environment in which the switch is maintained and which it is monitoring.

While not limited to such use, the improved differential pressure switch has especial utility in a vehicular expandable confinement or inflatable "air bag" safety restraint system. In what is commonly known as a hybrid system, certain safety restraint systems utilize, in addition to a gas generator for the generation of gas, a vessel which stores compressed gas to supply additional gas under pressure to protect the occupants of the vehicle upon impact thereof with a harm producing object.

2. Description of the Prior Art

The expandable confinement or inflatable bag has a collapsed, folded, inoperative condition for storage in a steering wheel, dashboard, or other location within a vehicle forward of a normal occupant position. Upon the occurrence of a collision of the vehicle, expansion of the inflatable bag may be effected or augmented by a fluid supply in the form of a pressure vessel defining a chamber which contains a supply of pressurized gas. The stored gas is released from the chamber by rupturing a portion of the pressure vessel which communicates with suitable gas directing means with the interior of the inflatable bag. The bag inflates in front of the occupant and acts as a protective cushion. The pressurized supply of gas is a very important part of the system. If the gas pressure falls below a predetermined level, the system will not operate.

Thus, in an inflatable bag safety restraint system that depends for its operation upon stored compressed gas, there is a need to monitor the pressurized vessel containing the stored gas to detect any leakage of gas.

By way of example and not limitation, it is noted that such pressurized vessel can be pressurized with an inert gas, such as argon, or a mixture of argon and another inert gas, to approximately 3200 psi at room temperature. Such vessel must be adapted to maintain the stored gas pressure so that the pressure does not drop by more than about 200 psi when at room temperature during the life of the vehicle which may be ten (10) years or more. Such limits are by way of example only and are not intended in any manner to place restrictions on the scope of the claimed invention.

It has been proposed in the prior art to provide means for detecting loss in the pressure in a pressurized vessel caused by means other than temperature change, such as a leak in the vessel or other damage thereto. The state of the prior art, in this connection, is indicated by the following U.S. Pat. Nos.:

| Patent No. | Issue Date | Patentee |
|---|---|---|
| 1,582,154 | April 27, 1926 | A. Zeiher et al. |
| 3,723,684 | March 27, 1973 | R. Greenwood |
| 3,735,376 | May 22, 1973 | J. M. Kermer et al. |
| 3,760,350 | Sept. 18, 1973 | E. L. Johnson |
| 3,818,764 | June 25, 1974 | J. P. Wagner |
| 3,850,039 | Nov. 26, 1974 | H. G. Brakebill |

-continued

| Patent No. | Issue Date | Patentee |
|---|---|---|
| 3,859,845 | Jan. 14, 1975 | J. T. Sawyer |
| 4,049,935 | Sept. 20, 1977 | W. P. Gruber |
| 5,073,124 | Dec. 17, 1991 | F. R. Powell |
| Russian 726603 | Aug. 4, 1980 | |
| French 2 431 178 | Aug. 2, 1980 | J. Segall et al. |

The pressure detecting means disclosed in the foregoing patents are characterized, in general, by their complexity.

U.S. Pat. No. 1,582,154 discloses an oil pressure-controlled indicator for motors comprising a flexible diaphragm, a pair of contacts mounted on and movable with the diaphragm and adapted to be moved into engagement with each other in response to failure of oil pressure.

U.S. Pat. No. 3,723,684 discloses a pressure responsive switch wherein axial force applied by a diaphragm responsively to pressure in a tank loads parallel flexible contact blades, causing them to bend apart. With decrease in tank pressure the loading of the contact blades is reduced. This causes them to move together to close a warning circuit.

U.S. Pat. No. 3,818,764 employs a hollow ribbon-like elongated bourdon tube which twists and untwists to operate an electric switch in response to a pressure differential across the wall of the tube.

In U.S. Pat. No. 5,073,724, positioned interiorly of each of a plurality of flexible tubular elements, normally out of contact with the conductive inner wall thereof, is a contact pin. Interconnection of the contact pin and the inner wall is effected by the application of external fluid pressure to the tubular element.

Russian patent 726603 discloses a pressure switch having inner flexible diaphragms forming a pressure chamber and outer movable contacts that close upon the application of pressure to the chamber. Applied pressure through a channel to the chamber deforms the diaphragms and the movable contacts, causing the latter to move apart and make contact with other fixed contacts in a series arrangement.

French patent 2 431 178 discloses an electric switch involving one or more non-metallic conducting membranes arranged to make contact with metal or other membrane electrodes responsively to shock, pressure, weight, etc., and operative for uses such as alarms, automatic door openers, etc.

In the others of the listed patents, fluids of a control pressure and of a pressurized vessel being monitored are separated from each other by a single flexible diaphragm. This necessitates the use of relatively complex and costly structural arrangements for sensing the deflections of the diaphragm resulting from changes in the differential pressure between the control pressure and that of the pressurized vessel.

Thus, there is a need and a demand for a simple, low cost differential pressure switch, of high reliability, which is responsive to the pressure of a stored gas, that is, a control pressure within the switch, and the differential between that pressure and the pressure of a pressurized vessel in which the switch is positioned, which latter pressure is being monitored.

SUMMARY OF THE INVENTION

An object of the invention is to provide an improved differential pressure switch for use in a pressure vessel.

Another object of the invention is to provide an improved differential pressure switch having particular utility, as a leak detector, detecting when the pressure vessel loses pressure and providing an indication if the switch fails.

Still another object of the invention is to provide an improved differential pressure switch for sensing leaks from substantially sealed vessels confining gases at predetermined pressures, which switch increases reliability and reduces cost.

A further object of the invention is to provide an improved differential pressure switch which is simple in construction, low in cost, and highly reliable over long periods of continued use for detecting leaks from a vessel storing compressed gas that is provided in a vehicular occupant restraint system for inflating an inflatable bag or bags for the protection of the occupants in the event of a collision.

These and other objectives and advantages of the invention are achieved by the use of a device having a chamber in which a known or control pressure is confined. The known pressure in the chamber is enclosed by first and second mirror symmetrical flexible diaphragms, at least the contacting portions of which are electrically conductive. The diaphragms are positioned in confronting relation, being separated by an electrically non-conductive spacer having first and second sides with the first diaphragm attached to one side and the second diaphragm attached to the second side. The diaphragms so assembled act as a closing switch. The function of the switch is such that the known pressure is set at a pressure that is lower than that of the pressure within a vessel containing stored gas. When the device is enclosed in the vessel and the vessel is pressurized, the diaphragms are forced into contact with each other in the central region of the diaphragms and provide electrical conductance therebetween, in effect providing a closed switch. If the pressure in the vessel drops below a particular, that is, a predetermined threshold, the pressure within the chamber causes the diaphragms to separate and thereby discontinue electrical conduction therebetween, thus opening the switch. With the same gas, argon, for example, contained in the device and in the pressurized vessel, and with the device enclosed in the pressurized vessel, thermal effects cancel each other. Additionally, the device is "fail-safe," that is, if the seal between the diaphragms fail, the pressures in the vessel and the chamber equalize and the switch opens. Discrete electrical components such as a resistor, capacitor, etc., may be connected in a series or parallel circuit with the diaphragms to meet diagnostic needs.

The various features of novelty which characterize the invention are pointed out with particularity in the claims annexed to and forming a part of the specification. For a better understanding of the invention, its operating advantages, and specific objects attained by its use, reference is made to the accompanying drawings and descriptive matter in which a preferred embodiment of the invention is illustrated.

BRIEF DESCRIPTION OF THE DRAWINGS

With this description of the invention, a detailed description follows with reference being made to the accompanying figures of drawings which form part of the specification, in which like parts are designated by the same reference numbers, and of which.

DESCRIPTION OF THE PREFERRED EMBODIMENT

Figure 2:
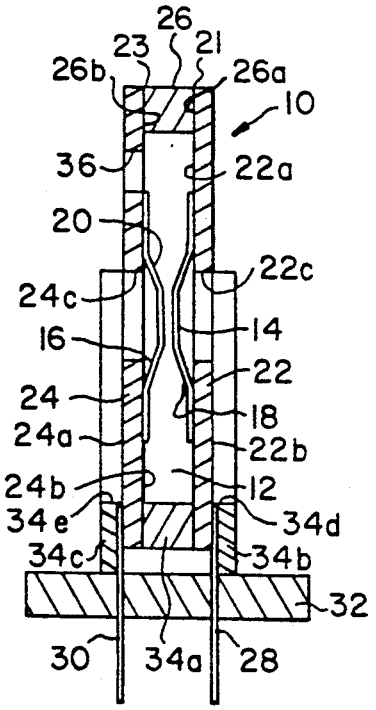
FIG. 2 is a cross sectional view of the pressure differential switch of FIG. 1, taken along the lines 2—2 of FIG. 1.
Figure 1:
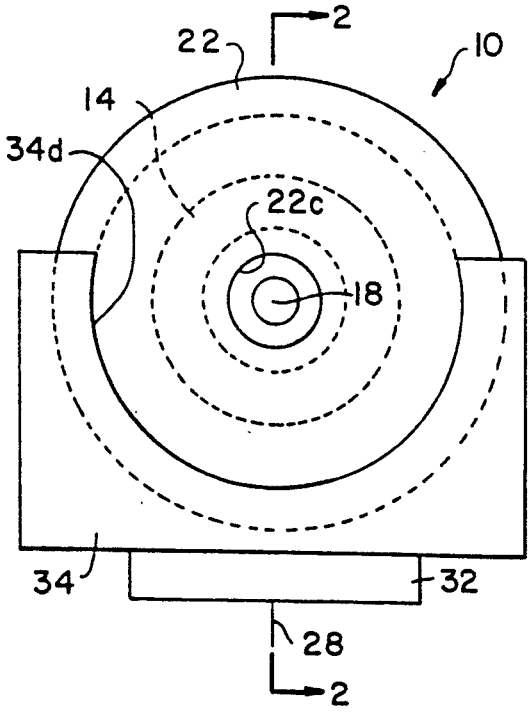
FIG. 1 is a front view of an embodiment of the pressure differential switch according to the invention.
Figure 4:
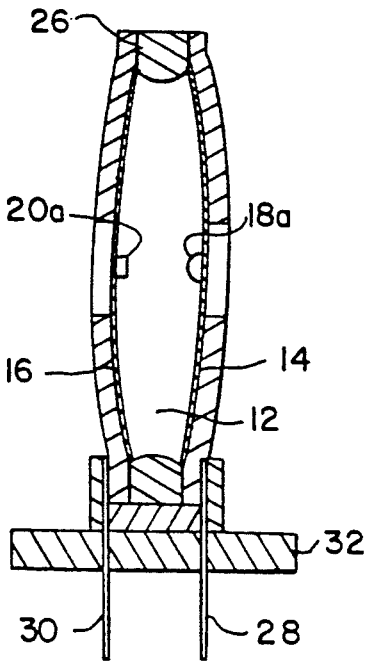
FIG. 4 is an exaggerated fragmented cross sectional view of the differential pressure switch illustrating the "open" position thereof with the switch exposed to atmospheric conditions.
Figure 5:
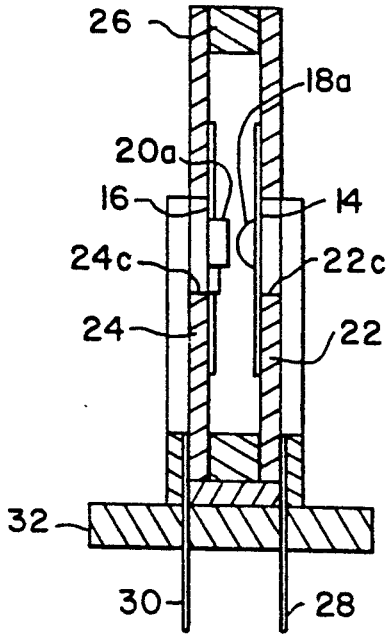
FIG. 5 is a cross sectional view of the pressure differential switch illustrating the "open" position thereof, with the switch pressurized and the pressurized vessel unpressurized, that is, permitting leakage.

Referring to FIGS. 1 and 2 of the drawings, a pressure differential switch 10, according the invention, includes a chamber 12 which is pressurized to a predetermined reference or control level. The chamber 12, which is hermetically sealed, is defined by two electrically conductive flexible diaphragms 14 and 16. Each of the diaphragms 14 and 16 has a raised surface 18 and 20, respectively, in the central region thereof. Optionally, electrically conductive beads 18*a* and 20*a* may be provided at the center of the central region of the diaphragms 14 and 16, respectively, with one of the beads 18*a* having a convex contacting surface and the other 20*a* having a flat surface, as shown in FIGS. 4 and 5.

The diaphragms 14 and 16, which, typically, may be made out of stainless steel or other suitable material including inconel and carbon steel, are positioned in parallel relation to each other. Each of the diaphragms 14 and 16, termed first and second diaphragms, respectively, hereinafter, is attached in a symmetrical manner, as by brazing, in sealing relation to a respectively associated electrically conductive protective ring or washer 22 and 24. The protective rings 22 and 24, in turn, are mounted in spaced relation to each other on the opposite sides of an electrically non-conductive spacer ring or washer 26, being sealed thereto by suitable sealing means indicated at 21 and 23, respectively.

More specifically each of the protective rings 22 and 24 has a first side 22*a* and 24*a*, respectively, and a second side 22*b* and 24*b*, respectively. The first diaphragm 14 is attached in sealing relationship to the first side 22*a* of the first protective ring 22, symmetrically with respect to an aperture 22*c* therein. The second diaphragm 16 is attached in sealing relationship to the second side 24*b* of the second protective ring 24, symmetrically with respect to an aperture 24*c* therein. The first side 22*a* of the first protective ring 22 is disposed in sealing relationship with a first side 26*a* of the spacer ring 26. The second side 24*b* of the second protective ring 24 is disposed in sealing relationship with the second side 26*b* of the spacer ring 26.

The arrangement is such that the diaphragms 14 and 16 are positioned so that the raised surfaces 18 and 20 are directly opposed. Apertures or openings 22*c* and 24*c* in the protective rings 22 and 24, respectively, allow external pressure to be applied to the diaphragms 14 and 16.

Electrical leads from the diaphragms 14 and 16 are attached to output pins or lead wires 28 and 30, respectively, through a header 32. To that end, each of the lead wires 28 and 30 may be welded to a respectively associated one of the protective rings 22 and 24. A suitable housing 34 may be provided to protect the pressure differential switch 10. The housing 34 includes a base 34*a* and parallel vertical walls 34*b* and 34*c*, as seen in the drawing, that are spaced to receive the assembled diaphragms 14 and 16, the protective rings 22 and 24 and the spacing ring 26 in a snug fit. Cutouts 34*d* and 34*e* in the housing expose a substantial portion of each of the protective rings 22 and 24 including the apertures 22*c* and 24*c* therein, respectively.

Pressurization of the chamber 12 of the differential pressure switch 10 may be effected in a pressurized atmosphere of argon during assembly of the diaphragms 14 and 16 to protective rings 22 and 24, respectively associated therewith, and to the spacer ring 26. No fill ports are required when the chamber 12 is pressurized during the assembly process. Optionally, pressurization may be effected through a fill port 36 provided in protective ring 22, as shown in FIG. 2. Upon charging or pressurizing the chamber 12 to the desired pressure level through the fill port 36, the latter may be closed off in any suitable manner, as by welding, for example. Pressurizing the chamber 12 does not involve penetration of the wall of the diaphragm 14. This is for the reason that the diameter of the protective ring 22, as shown, is sufficiently greater than that of the diaphragm 12 to allow access to the chamber 12 from the outside through the protective ring 22 alone.

When the diaphragms 14 and 16 are pressurized internally, as herein disclosed, with low pressure on the outside, that is externally thereof, the diaphragms 14 and 16 do not make electrical contact. When the diaphragms 14 and 16 are pressurized externally, electrical contact between them is made.

In accordance with the invention, the reference or control pressure level to which the chamber 12 is selected to be pressurized is lower by about 200–300 psi than that of the pressure vessel which is to be monitored by the pressure differential switch 10.

Figure 3:
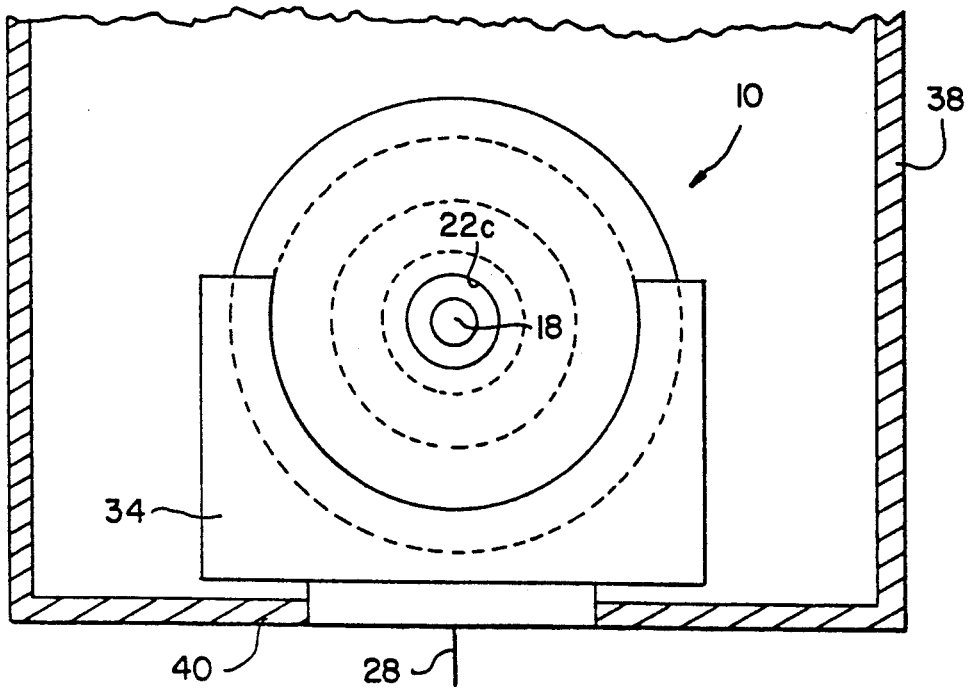
FIG. 3 is a view showing the pressure differential switch mounted inside of a pressurized vessel.

In FIG. 3, the differential pressure switch 10 is shown positioned inside a pressurized vessel 38 containing compressed gas such as argon at a pressure of about 3200 psi, being mounted to a wall 40 in sealing relation by the header 32. While not so shown for convenience of illustration, the pressurized vessel 38 may take the form of a cylinder or bottle. In such case, the wall of the pressurized vessel 38 to which the pressurized differential switch 10 is attached by header 32 may desirably comprise an end wall thereof.

The pressurized vessel 38 may be made of carbon steel or other suitable material.

As illustrated in FIG. 4, in atmospheric environmental conditions, the pressure within the pressurized chamber 12 is higher than atmospheric pressure. This causes the diaphragms 14 and 16 to bow out away from each other, thus assuring breaking of the electrical circuit between the diaphragms 14 and 16.

With the pressure differential switch 10 positioned within a pressurized vessel 38, as illustrated in FIG. 3, if the pressure within the pressurized vessel 38, because of a leak therein, drops below a predetermined level, in particular the pressure level to which the chamber 12 of the pressurized differential switch 10 has been charged, for example, 3000 psi, the pressure within the chamber 12 becomes higher than the pressure within the pressurized vessel 38. This causes the pressurized differential switch to open, as in differential switch 10, as shown in FIG. 5.

Figure 6:
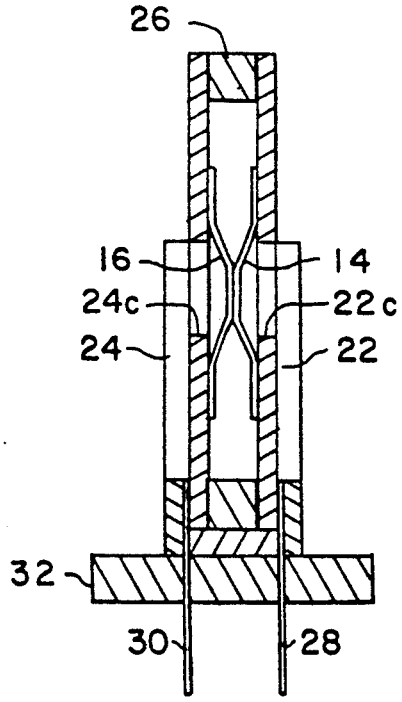
FIG. 6 is a cross sectional view of the pressurized differential switch illustrating the "closed" position thereof, with the switch pressurized and the pressurized vessel pressurized.
Figure 7:
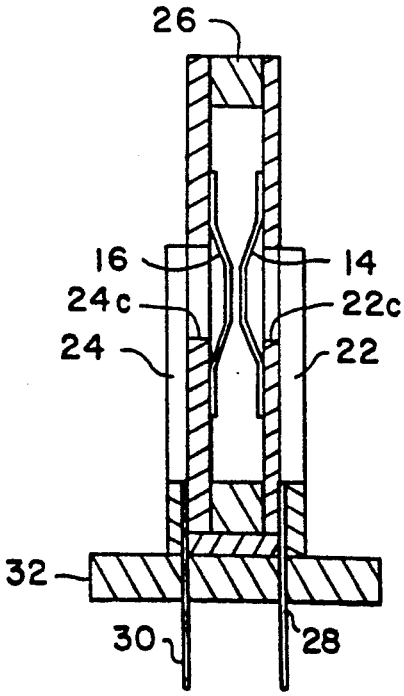
FIG. 7 is a cross sectional view of the pressurized differential switch illustrating the "open" position thereof resulting when the pressure of the switch and that of the pressurized vessel are the same.

With the pressure differential switch 10 positioned within a pressurized vessel 38 as illustrated in FIG. 3 in which the walls thereof are impervious to the confined gas and thus there is no leak, the diaphragms 14 and 16 are pressed together, as shown in FIG. 6, closing the circuit and maintaining electrical continuity.

While the invention has been illustrated showing the diaphragms 14 and 16 as having a diameter less than that of the protective rings 22 and 24, it will be understood that, if desired, the diaphragms 14 and 16 and the protective rings 22 and 24 may all have substantially the same diameter. Pressurization of the chamber 12 defined by the diaphragms 14 and 16 in such embodiment of the invention may be effected in a pressurized atmosphere of argon during assembly of the diaphragms.

It is also contemplated that, in accordance with the invention, the diaphragms 14 and 16 may be so characterized, if desired, as to be snap acting in operation, that is, stable only in either of two positions. Such snap operation of the diaphragms is advantageous for defining the finite contact pressure at which there is conductance between the diaphragms.

Thus, in accordance with the invention, there has been provided an improved differential pressure switch having utility for monitoring the pressure in pressurized vessel, which switch is characterized by the simplicity thereof, reduced cost of manufacturing, and increased reliability. The improved pressure differential switch has particular utility for detecting leaks from a vessel storing compressed gas that is provided in a vehicular occupant restraint system for inflating an inflatable bag or bags for the protection of the occupants in the event of a collision.

The pressure differential switch of the invention has a unique benefit, in that, if pressure leaks into the chamber 12, or if the pressurized vessel being monitored leaks, the electrical contact between the diaphragms 14 and 16 breaks, that is, discontinues. Thus, in operation, the switch is "fail safe."

With this description of the invention in detail, those skilled in the art will appreciate that modifications may be made to the invention without departing from the spirit thereof. Therefore, it is not intended that the scope of the invention be limited to the specific embodiment that has been illustrated and described. Rather, it is intended that the scope of the invention be determined by the scope of the appended claims.

What is claimed is:

1. A pressure differential switch comprising:

first and second diaphragms, each of which has a raised surface and contacting portion, at least, which is electrically conducting, an electrically non-conductive spacer ring having a first side and a second side, and attaching means attaching said first diaphragm and said second diaphragm in sealing relation to said first and second sides, respectively, of said spacer ring thereby forming an hermetically sealed chamber therebetween with said contacting portions thereof in directly opposed relation, wherein said attaching means include first and second protective rings each of which has an aperture therein in a central portion thereof and has a first side and a second side, said first diaphragm being attached in sealing relationship to said first side of said first protective ring symmetrically with respect to the aperture therein, said second diaphragm being attached in sealing relationship to said second side of said second protective ring symmetrically with respect to the aperture therein, with the first side of said first protective ring being disposed in sealing relationship with the first side of said spacer ring and the second side of said second protective ring being disclosed in sealing relationship with the second side of said spacer ring, whereby with said chamber pressurized to a predetermined reference level, in atmospheric environmental conditions the pressurized chamber has higher than atmospheric pressure, causing the said diaphragms to bow away from each other, thus assuring that the contacting portions thereof do not contact each other, whereby with the pressure of the environment external to said chamber higher by a predetermined amount than said predetermined reference level, said diaphragms are pressed together, thus bringing the contacting portions thereof into contact with each other and establishing electrical conductance therebetween, and whereby, if the seal of said chamber fails, the equalization of pressure between the pressure of the environment external to the chamber and the pressure in the chamber causes the said diaphragms to move the contacting portions thereof out of contact with each other.

2. A pressure differential switch as defined by claim 1 wherein said first and second protective rings are each electrically conductive.

3. A pressure differential switch as defined by claim 2 wherein said first and said second diaphragms are attached to said first and second protective rings by mechanical bonding.

4. A pressure differential switch as defined by claim 2 further including a separate electrical lead attached to each of said first and second protective rings.

5. A pressure differential switch as defined by claim 4 wherein said first and second diaphragms each include a bead provided at the contacting portion thereof, said beads being disposed in direct opposition, with one of said beads having a convex surface and the other a flat surface.

6. A pressure differential switch as defined by claim 2 further including a housing therefor, said housing including a base and parallel walls that are spaced to receive said switch over a portion, at least, thereof in a snug fit, with each of said walls having a circular cutout therein to expose a substantial portion of the adjacent protective ring including the aperture therein.

7. A pressure differential switch comprising:

first and second diaphragms, each of which has a raised surface and contacting portion, at least, which is electrically conducting, an electrically non-conductive spacer ring having a first side and a second side, and attaching means attaching said first diaphragm and said second diaphragm in sealing relation to said first and second sides, respectively, of said spacer ring thereby forming an hermetically sealed chamber therebetween with said contacting portions thereof in directly opposed relation, whereby with said chamber pressurized to a predetermined reference level, in atmospheric environmental conditions the pressurized chamber has higher than atmospheric pressure, causing the said diaphragms to bow away from each other, thus assuring that the contacting portions thereof do not contact each other, whereby with the pressure of the environment external to said chamber higher by a predetermined amount than said predetermined reference level, said diaphragms are pressed together, thus bringing the contacting portions thereof into contact with each other and establishing electrical conductance therebetween, and whereby, if the seal of said chamber fails, the equalization of pressure between the pressure of the environment external to the chamber and the pressure in the chamber causes the said diaphragms to move the contacting portions thereof out of contact with each other.

8. A pressure differential switch as defined by claim 7 wherein said diaphragms are mirror symmetrical.

9. A pressure differential switch as defined by claim 7 further including a separate electrically conductive lead connected to the contacting portion of each of said first and second diaphragms.

* * * * *